US009361834B2

(12) United States Patent
Feng et al.

(10) Patent No.: US 9,361,834 B2
(45) Date of Patent: Jun. 7, 2016

(54) METHOD AND APPARATUS FOR ADJUSTING THE BRIGHTNESS OF A DISPLAY AND A DISPLAY SYSTEM

(71) Applicant: OPERA SOFTWARE ASA, St. Hanshaugen, Oslo (NO)

(72) Inventors: Jiabin Feng, Beijing (CN); Le Chang, Beijing (CN); Wei Chen, Beijing (CN); Xin Guo, Beijing (CN)

(73) Assignee: OPERA SOFTWARE ASA, Oslo (NO)

( * ) Notice: Subject to any disclaimer, the term of this patent is extended or adjusted under 35 U.S.C. 154(b) by 124 days.

(21) Appl. No.: 14/151,395

(22) Filed: Jan. 9, 2014

(65) Prior Publication Data

US 2014/0198137 A1 Jul. 17, 2014

Related U.S. Application Data

(60) Provisional application No. 61/760,926, filed on Feb. 5, 2013.

(30) Foreign Application Priority Data

Jan. 15, 2013 (CN) ..... 2013 1 0013710

(51) Int. Cl.
*G09G 5/10* (2006.01)
*G09G 3/34* (2006.01)

(52) U.S. Cl.
CPC ..... *G09G 3/3406* (2013.01); *G09G 2320/0626* (2013.01); *G09G 2320/0646* (2013.01)

(58) Field of Classification Search
CPC ..... G09G 3/3406; G09G 2320/0626; G09G 2320/0646; G09G 2320/06; G09G 2320/0606; G09G 2320/0653
See application file for complete search history.

(56) References Cited

U.S. PATENT DOCUMENTS

| | | | | |
|---|---|---|---|---|
| 6,204,840 | B1 * | 3/2001 | Petelycky et al. | 715/202 |
| 2008/0315939 | A1 * | 12/2008 | Olson | 327/346 |
| 2011/0010626 | A1 * | 1/2011 | Fino | G06F 3/04847 715/727 |
| 2012/0036480 | A1 * | 2/2012 | Warner et al. | 715/833 |
| 2013/0328842 | A1 * | 12/2013 | Barnhoefer et al. | 345/207 |

* cited by examiner

*Primary Examiner* — Brent D Castiaux
(74) *Attorney, Agent, or Firm* — Birch, Stewart, Kolasch & Birch, LLP

(57) ABSTRACT

The present application relates to a method and apparatus for adjusting the brightness of a display, and a display system. The method for adjusting the brightness of a display comprises: acquiring a brightness adjusting signal, wherein the brightness adjusting signal includes a position value indicative of a desired brightness of the display; comparing the position value with a first threshold, wherein an adjusting scale is defined according to a variable range of transparency of an object displayed on the display if the position value is smaller than the first threshold; generating a brightness value of the object according to the position of the position value in the adjusting scale; and applying the brightness value to the object displayed on the display. The method can adjust the transparency of the displayed object through the graphical system in an electronic device, thereby further lowering the brightness of the display.

18 Claims, 4 Drawing Sheets

METHOD AND APPARATUS FOR ADJUSTING THE BRIGHTNESS OF A DISPLAY AND A DISPLAY SYSTEM

The present application is a non-provisional of 61/760,926, and claims priority to Chinese Application 201310013710.3, filed on Jan. 15, 2013. The entire contents of each of these applications is hereby incorporated by reference.

TECHNICAL FIELD

The present application relates to display technologies, particularly a method and apparatus for adjusting the brightness of a display and a display system.

BACKGROUND

With the rapid development of computer and electronic technologies, displays have been disposed on many portable electronic devices to show various forms of information, such as texts, pictures or video information. Some displays, such as LCD displays, use an LED array or a fluorescent lamp as a backlight module, and use a liquid crystal tunable filter to control the contrast of the light emitted from the backlight module to display graphics thereon. The luminous intensity of the light emitted from the backlight module, i.e. a backlight luminous intensity can be controlled by an operating system of the electronic device. Thus, the electronic device may control the brightness of the display by controlling the luminous intensity of the light, thereby meeting the requirements of different applications.

In conventional technologies, the system platform of many portable electronic devices may provide a specific application programming interface (API). Applications may use the API to set or adjust the backlight luminous intensity of the display. However, the backlight luminous intensity can only be reduced to a finite non-zero minimum value. Therefore, when the backlight luminous intensity is at the minimum value, the brightness of the display may still be maintained at a relatively low brightness level. Under many circumstances, especially when an environmental luminous intensity is extremely low, the relatively low brightness level of the display is still too high relative to the environment, which may cause discomfort to a user.

Therefore, there is a need of a method and apparatus for adjusting the brightness of a display, which is capable of providing a broader brightness configuration of the display, especially with a much lower limit of the brightness.

SUMMARY OF THE INVENTION

An objective of the present application is to provide a method and apparatus for adjusting the brightness of a display, which is capable of providing a broader brightness configuration of the display, especially with a much lower limit of the brightness.

In an aspect, the present application provides a method for adjusting the brightness of a display, comprising: acquiring a brightness adjusting signal, wherein the brightness adjusting signal includes a position value indicative of a desired brightness of the display; comparing the position value with a first threshold, wherein an adjusting scale is defined according to a variable range of transparency of an object displayed on the display if the position value is smaller than the first threshold; generating a brightness value of the object according to the position of the position value in the adjusting scale; and applying the brightness value to the object displayed on the display.

When the backlight luminous intensity is low, for example, the backlight luminous intensity is at the minimum value that an application programming interface is capable of configuring, the method of the present application can use a graphical system of an electronic device to change the transparency of the displayed object. Therefore, the brightness of the display is further lowered by reducing the transparency of the displayed object.

In certain embodiments, the comparing step further comprises: the adjusting scale is defined according to a variable range of backlight luminous intensity of the display if the position value is equal to or greater than the first threshold.

In certain embodiments, the brightness value changes linearly with the position value if the position value is equal to or greater than the first threshold.

In certain embodiments, the brightness value changes nonlinearly with the position value if the position value is smaller than the first threshold.

In certain embodiments, the brightness value changes in a logarithmic function of the position value if the position value is smaller than a second threshold, wherein the second threshold is smaller than the first threshold.

In certain embodiments, the brightness adjusting signal is generated in response to a sliding action on the display by a user.

In certain embodiments, the first threshold corresponds to a minimum brightness that a platform application programming interface coupled to the display can configure.

In certain embodiments, the object is a user interface.

In another aspect, the present application further provides an apparatus for adjusting the brightness of a display, which comprises: an acquiring module, configured to acquire a brightness adjusting signal, wherein the brightness adjusting signal includes a position value indicative of a desired brightness of the display; a comparing module, configured to compare the position value with a first threshold, wherein an adjusting scale is defined according to a variable range of transparency of an object displayed on the display if the position value is smaller than the first threshold; a generating module, configured to generate a brightness value of the object according to the position of the position value in the adjusting scale; and an applying module, configured to apply the brightness value to the object displayed on the display.

In a further aspect, the present application further provides a display system, which comprises: a display, an input module, and the apparatus for adjusting the brightness of the display in the previous aspect, wherein the input module is configured to generate the brightness adjusting signal in response to an input of a user; and the display is configured to display the object in response to the application of the brightness value.

The foregoing has outlined, rather broadly, features of the present application. Additional features of the present application will be described, hereinafter, which form the subject of the claims of the present application. It should be appreciated by those skilled in the art that the conception and specific embodiments disclosed herein may be readily utilized as a basis for modifying or designing other structures or processes for carrying out the objectives of the present application. It should also be realized by those skilled in the art that such equivalent constructions do not depart from the spirit and scope of the present application as set forth in the appended claims.

BRIEF DESCRIPTION OF THE DRAWINGS

The aforementioned features and other features of the application will be further described in the following paragraphs by referring to the accompanying drawings and the appended claims. It will be understood that, these accompanying drawing merely illustrate some embodiments in accordance with the present application and should not be considered as limitation to the scope of the present application. Unless otherwise specified, the accompanying drawings need not be proportional, and similar reference characters generally denote similar elements.

DETAILED DESCRIPTION OF ILLUSTRATIVE EMBODIMENTS

The following detailed description refers to the accompanying drawings as a part of the present application. The illustrative embodiments described in the detailed description, the accompanying drawings and the claims are not limiting, and other embodiments may be adopted, or modifications may be made without deviating from the spirit and subject of the application. It should be understood that, the various aspects of the application described and graphically presented herein may be arranged, replaced, combined, divided and designed in many different configurations, and these different configurations are implicitly included in the application.

In the following paragraphs, some specific terms will be used to clearly describe the illustrative embodiments. However, the intent of using these terms is not to limit the scope of protection of this application, the scope of these terms should extend to any equivalent replacements that achieve substantially the same objective in substantially the same way.

Figure 1:
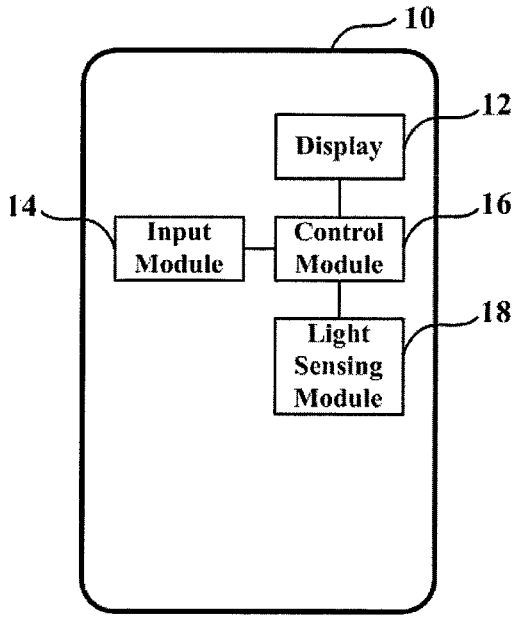
FIG. 1 shows an electronic device 10 suitable to apply a method for adjusting the brightness of a display according to an embodiment of the present application.

FIG. 1 shows an electronic device 10 suitable to apply a method of the present application in an embodiment. The electronic device may be a mobile communication terminal (such as a mobile phone). Furthermore, the electronic device 10 may be a laptop, a pad, a personal digital assistant (PDA) or other electronic devices with a display.

As shown in FIG. 1, the electronic device 10 has a display 12, which may be a displaying module with backlight displaying. For example, the display 12 may be an LCD display having a backlight module whose light luminous intensity is controllable. The brightness of the display 12 can be at least partially adjusted by controlling the luminous intensity of the light emitted from the backlight module. In other words, the brightness of the display 12 is adjusted by controlling the backlight luminous intensity. In certain embodiments, the display 12 may be a touch sensing display, i.e. the display 12 integrates an input module 14 thereon. For example, the input module 14 may be a touch sensing module. The touch sensing module generally overlaps with a displaying zone of the display 12. In a practical application, the touch sensing module may generate an input signal in response to a touch action on the display 12 by a user. For example, the touch sensing module may generate the input signal in response to a pressing action or sliding action of a finger of the user, or a touch pen or other tools used by the user. With such input module 14, the user may input a control instruction to control the operation of the electronic device 10. It will be readily appreciated that the electronic device may have or alternatively use other types of input module, such as a keyboard, a mouse, a track ball, a sound control input module or the like.

The electronic device 10 further includes a control module 16 coupled to the display 12 and the input module 14. The control module 16 receives an input signal or a control instruction from the input module 14, processes such input signal or control instruction, and controls the brightness of the display 12. In the embodiment shown in FIG. 1, the control module 16 may run a software platform or an operating system to implement data or instruction processing. The software platform or operating system may be provided with an application programming interface. An application can access the API to set or adjust a parameter indicative of the backlight luminous intensity of the backlight module. The application may be an internet browser or a reading software. It will be readily appreciated that the control module 16 may be implemented by hardware, software, firmware or any combination thereof. For example, the control module 16 may be implemented by one or more circuits, programmable processor(s), ASIC(s), PLD(s), FPGA(s) or other suitable devices.

It can be understood that the above electronic device 10 merely illustratively show a portion of its modules. In practical applications, the electronic device may include other functional modules, such as a power source, a communication module or a storage module, etc. In certain embodiments, the electronic device 10 may have a light sensing module 18 coupled to the control module 16. The light sensing module 18 senses any change of the environmental light to generate a corresponding environmental light luminous intensity signal and provide such signal to the control module 16.

Figure 2:
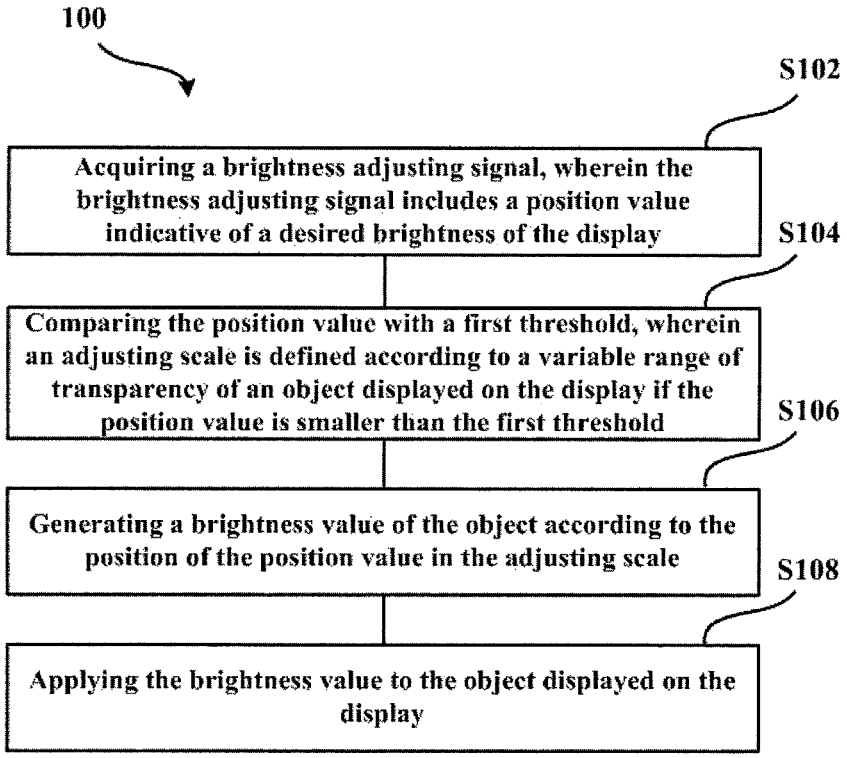
FIG. 2 shows a method 100 for adjusting the brightness of a display according to an embodiment of the present application.

FIG. 2 shows a method 100 for adjusting the brightness of a display according to an embodiment of the present application. The method 100 may be executed by the electronic device 10 shown in FIG. 1.

As shown in FIG. 2, the method 100 includes:

Step 102: acquiring a brightness adjusting signal, wherein the brightness adjusting signal includes a position value indicative of a desired brightness of the display;

Step 104: comparing the position value with a first threshold, wherein an adjusting scale is defined according to a variable range of transparency of an object displayed on the display if the position value is smaller than the first threshold;

Step 106: generating a brightness value of the object according to the position of the position value in the adjusting scale; and Step 108: applying the brightness value to the object displayed on the display.

In certain embodiments, the method for adjusting the brightness of a display includes: acquiring a brightness adjusting signal including a desired brightness of the display; comparing the position value with a first threshold; defining the adjusting scale according to a variable range of backlight luminous intensity of the display if the position value is equal to or greater than the first threshold; generating a brightness value of the object according to the position of the position value in the adjusting scale; and applying the brightness value to the object displayed on the display.

In certain embodiments, the method for adjusting the brightness of a display specifically includes: acquiring a brightness adjusting signal including a desired brightness of the display; comparing the position value with a first threshold; defining the adjusting scale according to a variable range of transparency of an object displayed on the display if the position value is smaller than the first threshold; generating a brightness value of the object according to the position of the position value in the adjusting scale; and applying the brightness value to the object displayed on the display.

In the following paragraphs, the method 100 will be elaborated with reference to FIGS. 1 and 2.

Firstly, when a user of the electronic device 10 wants to adjust the brightness of the display 12, he or she can input a brightness adjusting instruction via the input module 14. The brightness adjusting instruction may contain information regarding a desired brightness of the display 12. For example, the user may input a specific value of the desired brightness via the input module 14, which is a ratio relative to a maximum value of the brightness that the display 12 is capable to display. Alternatively, the user may input a variation of the desired brightness to a current brightness of the display 12, such as a desired increase or decrease of the brightness of the display 12. Furthermore, the control module 16 can determine the desired brightness according to the variation and the current brightness of the display 12. In certain embodiments, the input module 14 is a touch sensing input module, such as a touch sensing screen, which may generate an instruction indicative of the brightness adjustment according to a sliding action of the user. For example, a rightward or upward sliding action of the user may generate a brightness adjusting instruction indicating that the brightness will increase, and the length of the sliding action indicates the variation of the brightness. Correspondingly, a leftward or downward sliding action of the user may generate a brightness adjusting instruction indicating that the brightness will decrease, and the length of the sliding action indicates the variation of the brightness.

Figure 3:
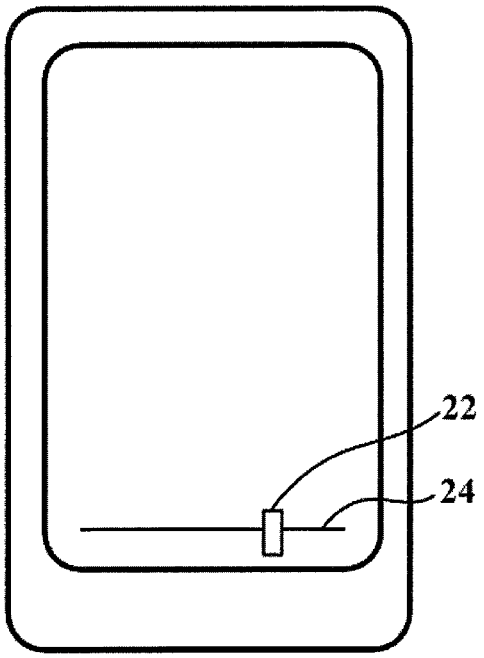
FIG. 3 shows an electronic device on which a slider component is disposed according to an embodiment of the present application.

In certain embodiments, the display 12 does not display a symbol or a number indicative of the current brightness, the user may determine the current brightness of the display according to his or her visual perceptions, thereby determining whether or not to adjust the brightness of the display 12. In certain embodiments, an image or interface indicative of the current brightness may be displayed on the display 12, such as a slider component. FIG. 3 shows an electronic device on which the slider component is disposed according to an embodiment of the present application. As shown in FIG. 3, the slider component has a slider 22 and a position bar 24 (or a position frame). The slider 22 may slide in the position bar 24 in response to an input of the user, and the position of the slider 22 in the position bar 24 indicates the current brightness of the display 12.

As described above, the brightness adjusting instruction of the user may include information relating to the desired brightness of the display. In Step 102, after receiving the brightness adjusting instruction, the control module 16 of the electronic device 10 can further convert the instruction to a brightness adjusting signal that can be recognized by the software or operating system run on the electronic device 10. Accordingly, the information relating to the desired brightness of the display can be converted into a position value indicative of the desired brightness of the display, and then the brightness adjusting signal includes the position value. For example, the position value may be a ratio of a position where the slider 22 will be moved relative to the length of the position bar 24.

It should be noted that, the brightness adjusting signal may be automatically generated by the electronic device 10 according to an instruction of a predefined condition in practical application. For example, the electronic device 10 may include a light sensing module for sensing the environmental luminous intensity. When the environmental luminous intensity is at different scopes, the electronic device 10 can compare the environmental luminous intensity with some predefined position values, to automatically generate brightness adjusting signal including different position values according to the comparison. Therefore, the electronic device 10 can automatically adjust the brightness of the display suitable for the environmental luminous intensity according to the change of the environmental luminous intensity.

Afterwards, in Step 104, the control module 16 processes the brightness adjusting signal and compares the position value included in the brightness adjusting signal with the first threshold. The first threshold may be preset in the control module 16 or pre-stored in an internal or external memory module of the electronic device 10, and then be called by the control module 16 according to application requirements. In practical applications, the first threshold is configured to separate different way to adjust the brightness. The control module 16 can determine the adjusting scale by comparing the position value with the first threshold. The adjusting scale is used for converting the position value to the brightness value of the object displayed on the display 12. For example, when the position value is equal to or greater than the first threshold, the control module 16 can adjust the brightness of the display 12 by changing the backlight luminous intensity of the display 12. Otherwise, the control module 16 may adjust the brightness of the display by changing the transparency of the object displayed on the display 12 instead of changing the backlight luminous intensity of the display. In certain embodiments, the object is a user interface or graphical user interface displayed by the display 12. In certain embodiments, the object may be a part of the user interface displayed on the display 12, such as a background image of the interface. Apparently, the brightness of the display 12 changes with the transparency of the object. The lower the transparency is, the lower the brightness of the display 12 is; and the greater the transparency is, the higher the brightness of the display 12 is. For embodiments where the brightness of the display 12 is indicated with numbers, the first threshold corresponds to a specific value between a value indicating the lowest brightness of the display and another value indicating the highest brightness of the display. For embodiments where the brightness of the display 12 is indicated with the slider component, the first threshold corresponds to a specific position in the position bar. Correspondingly, when the slider slides between the specific position and a position indicative of the lowest brightness of the display 12, the brightness of the display 12 is adjusted by changing the backlight luminous intensity of the display 12. When the slider slides between the specific position and a position indicative of the highest brightness of the display 12, the backlight luminous intensity is fixed and the transparency of the object displayed on the display changes. When the slider slides to the low brightness direction, the luminous intensity emitted out of the display 12 may be reduced to lower the brightness of the display 12. Therefore, when the backlight luminous intensity is at the minimum value that an application programming interface can configure (i.e. the lowest backlight luminous intensity), the brightness of the display can be further lowered by reducing the transparency of the object. This configuration can meet the requirement for low display brightness. Apparently, the first threshold may be set to a value higher than the lowest backlight luminous intensity that the API can configure. In certain embodiments, the first threshold may be set to a value corresponding to a brightness value of the display when the backlight luminous intensity is at the minimum value. In certain embodiments, the first threshold corresponds to a value wherein the backlight luminous intensity is 50% of the maximum backlight luminous intensity.

Specifically, in the electronic device 10, the brightness of the display 12 may be adjusted via the software platform or the operating system. The brightness value may include a first portion indicative of the backlight luminous intensity of the display, and a second portion indicative of the transparency of the object display on the display 12. The first position of the brightness value, i.e. the backlight luminous intensity, can be set or adjusted via accessing to the API by applications. The second portion of the brightness value, i.e. the transparency of the object, may be further set by a graphical system provided in the software platform or the operating system. For example, full-screen-size paint nodes may be overlapped with root/base nodes of a primitive figure when the system is initialized. The root/base nodes could make sure the overlapped paint nodes can be painted at last. The data indicative of the transparency of the object can then be set on the paint nodes. When the object displayed on the display is updated, i.e. the paint nodes are painted, the transparency can be applied to the displayed object in full screen. Apparently, the implementation for setting or displaying the transparency may change with different embodiments. However, it will be readily appreciated by those skilled in the art that the present application is not limited to the above embodiments, other transparency adjusting ways are also within the scope of the present application.

In practical applications, the transparency is usually represented by a data of specific size, such as an 8-bit data (i.e. the transparency can be set at a level between 0 and 255, 256 levels in total). Similarly, the backlight luminous intensity of the display 12 can also be represented by a data of specific size, such as a 4-bit data (i.e. the backlight luminous intensity can be set at a level between 0 and 15, 16 levels in total). It should be noted that the backlight luminous intensity may change continuously or semi-continuously. Thus, the term "level" in the present application refers to a unit variation in the backlight luminous intensity, or a multiple of the unit variation. As stated above, the position of the position value included in the brightness adjusting signal relative to the first threshold can be used to indicate different brightness adjusting ways. However, the level of the transparency is different from the level of the backlight luminous intensity, and the effect of each level of the transparency on the brightness of the display 12 is different from the effect of each level of the backlight luminous intensity on the brightness of the display 12. Therefore, the effect of variation of the position value on the actual brightness of the display 12 may be different in different adjusting ways. As a result, the brightness adjusting scale may be separately defined for different brightness adjusting ways. The brightness adjusting scale includes a variable range of the brightness, and the respective ratios of the brightness of the display changing with each level of the backlight luminous intensity or transparency of the object. In certain embodiments, a range between a position value corresponding to the highest brightness of the display and the first threshold includes the variable range of the backlight luminous intensity of the display, i.e. one or more levels of the position value in this range corresponds to a level of the backlight luminous intensity. Furthermore, a range between a position value corresponding to the lowest brightness of the display and the first threshold includes the variable range of the transparency of the object, i.e. one or more levels of the position value in this range corresponds to a level of transparency of the object. Alternatively, one or more levels of the position value in this range corresponds to one or more levels of transparency of the object.

After the adjusting scale is determined, in Step 106, the brightness value of the object displayed on the display is generated according to the position of the position value in the adjusting scale. As stated above, the brightness value may include the first portion indicative of the backlight luminous intensity of the display, and the second portion indicative of the transparency of the object displayed on the display 12. For example, the brightness value B may be expressed as (BL, TS), wherein the first portion BL ranges within [0, 15] and the second portion TS ranges within [0, 255].

For example, assuming the position value corresponding to the highest brightness is 100%, the position value corresponding to the lowest brightness is 0%, and the first threshold is 40%. The range of the position value ranging from 0% to 40% corresponds to the variable range of the transparency, such as 0-255 levels of the transparency. In particular, when the position value corresponding to the desired brightness is 30%, which is smaller than the first threshold, the adjusting scale may be defined according to the variable range of the transparency. The brightness value B may be expressed as (0, 191). In other words, the first portion BL of the brightness value is the minimum value 0 within the variable range of the backlight luminous intensity, and the second portion TS of the brightness value is at ¾ of the variable range of transparency, i.e. 191. For another example, when the position value corresponding to the desired brightness is 70%, which is greater than the first threshold, the brightness of the display may not be lowered by reducing the transparency of the object. Thus, the transparency is maintained in a default value 255 (i.e. the maximum value of the transparency), and the function of transparency adjustment is turned off. The first portion BL of the brightness B can be determined according to the adjusting scale defined by the variable range of backlight luminous intensity. Then the first portion BL is at ½ of the variable range of the backlight luminous intensity, i.e. 127.

It should be noted that, the above examples of the brightness value are determined assuming the brightness value changes linearly with the position value. In certain embodiments, when the position value is smaller than the first threshold, the second portion of the brightness value changes linearly with the position value. When the position value is greater than the first threshold, the first portion of the brightness value changes linearly with the position value.

Figure 4:
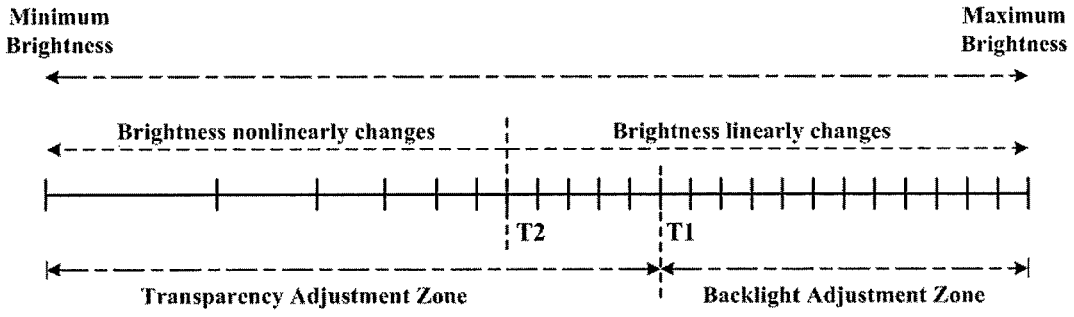
FIG. 4 shows an embodiment of the present application where the change of a brightness value is caused by the change of a position value.

In certain embodiments, the brightness value does not change linearly with the position value, and it may change nonlinearly with the position value, or at least change nonlinearly with the position value in a portion of the position value range. FIG. 4 shows an embodiment where the change of a position value causes nonlinear change of a brightness value.

As shown in FIG. 4, each scale in the axis x indicates a level of brightness value. On the right of the first threshold T1, the brightness value (specifically, the backlight luminous intensity) changes linearly with the position value. When the position value is smaller than the first threshold T1, i.e. on the left of the first threshold T1, the brightness value (specifically, the transparency) changes nonlinearly with the position value. Optionally, if the position value is smaller than a second threshold T2, the brightness value (specifically, the transparency) changes in a logarithmic function of the position value. The second threshold is smaller than the first threshold. For example, the second threshold is 50% to 90% of the first threshold, optionally 75% to 85% of the first threshold. When the position value is between the first threshold and the second threshold, the brightness value (specifically, the transparency) changes linearly with the position value.

Figure 5:
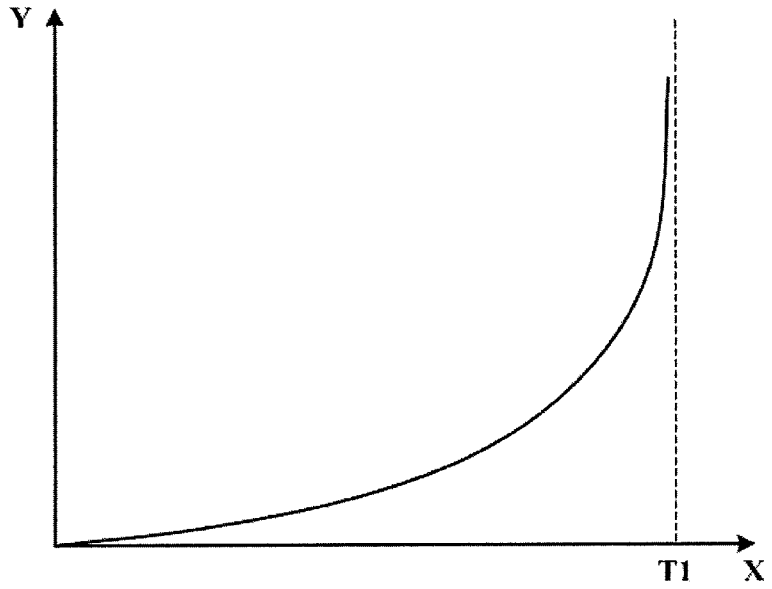
FIG. 5 shows a curve of the brightness value to the position value according to an embodiment of the present application.

FIG. 5 shows an embodiment of a curve of the brightness value to the position value. Axis X represents the position value and axis Y represents the second portion of the brightness value, i.e. the transparency. As shown in FIG. 5, the transparency generally changes in a logarithmic function of the position value. The smaller the position value is, the smaller the slope of the brightness value is. When the environmental luminous intensity is relatively low, human eyes are more sensitive to the change of the brightness of the display. Therefore, the nonlinear change of the brightness value can reduce the uncomfortable feeling of human eyes when the brightness of the display is adjusted to a smaller value. In other words, with the decrease of the environmental luminous intensity, the change of the brightness value caused by the same change in position value is getting smaller, which fits the visual perception of human eyes.

Figure 6:
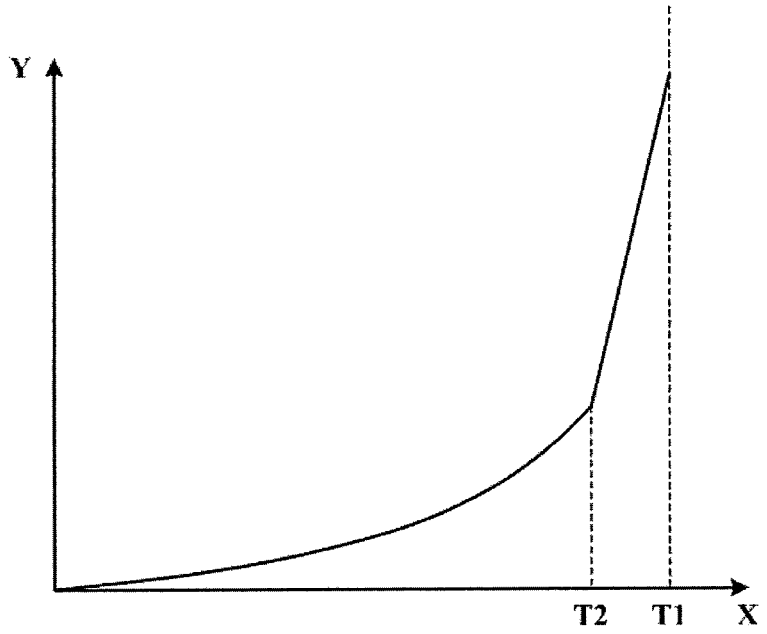
FIG. 6 shows a curve of the brightness value to the position value according to an embodiment of the present application.

FIG. 6 shows another embodiment of the curve of the brightness value to the position value. Axis X represents the position value, and axis Y represents the second portion of the brightness value, i.e. the transparency. As shown in FIG. 6, the transparency changes in a logarithmic function of the position value when the position value is smaller than the second threshold T2; and the transparency changes linearly with the position value when the position value is equal to or greater than the second threshold T2. When the position value is equal to the first threshold T1, the transparency is set as its maximum value. When the position value further increases exceeding the first threshold T1, the backlight luminous intensity may increase with the position value, for example, increase linearly with the position value.

Still referring to FIG. 2, after generating the brightness value of the display, in Step 108, the brightness value including the backlight luminous intensity and the transparency is applied to the object. Specifically, the first portion of the brightness value is applied to the system via the API to change the backlight luminous intensity of the backlight module of the display 12. The second portion of the brightness value is applied to the object through the graphical system to change the transparency of the object.

When the above steps are completed, the brightness of the display 12 can be set to a brightness desired by the user, thereby implementing the brightness adjustment of the display 12.

Figure 7:
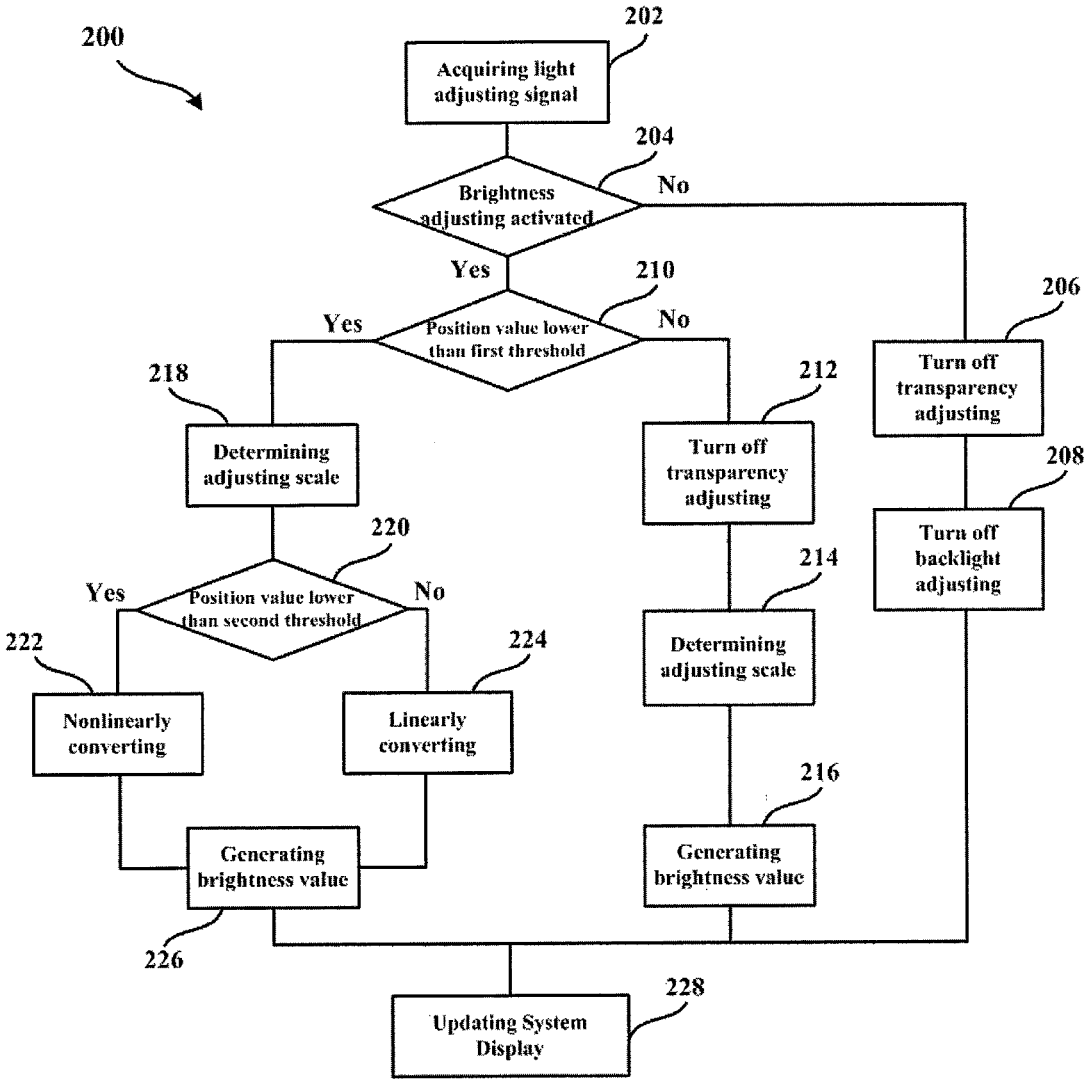
FIG. 7 shows a method 200 for adjusting the brightness of a display according to another embodiment of the present application.

FIG. 7 shows a method 200 for adjusting the brightness of a display according to another embodiment of the present application.

As shown in FIG. 7, in block 202, an electronic device acquires a brightness adjusting signal, which includes a position value representing a desired brightness value of the display. The brightness adjusting signal may be manually inputted by a user, or automatically generated by the electronic device according to other instructions or conditions provided by the control system of the electronic device. For example, the brightness adjusting signal may be generated according to change in environmental luminous intensity. Afterwards, in block 204, the electronic device determines whether or not to activate the brightness adjusting function. For example, the user may pre-set whether to turn on or turn off the brightness adjusting function. If the brightness adjusting function is turned off, the respective brightness adjusting functions using the transparency and the backlight luminous intensity are both turned off, as shown in block 206 and 208.

If the brightness adjusting function is activated, the position value is compared with a first threshold in block 210. If the position value is equal to or greater than the first threshold, the brightness adjusting function using the transparency is turned off in block 212. Afterwards, an adjusting scale is defined according to a variable range of the backlight luminous intensity in block 214, and a brightness value of the display is generated according to the position of the position value in the adjusting scale in block 216.

Otherwise, if the position value is smaller than the first threshold, the adjusting scale is defined according to a variable range of the transparency of the object in block 218, and the position value is compared with a second threshold which is smaller than the first threshold in block 220. If the position value is smaller than the second threshold, the position value is converted to a corresponding transparency value based on a nonlinear function such as a logarithm function in block 222. If the position value is equal to or greater than the second threshold, the position value is converted to a corresponding transparency value based on a linear function in block 224. Then the transparency value is obtained in block 226. Furthermore, the brightness value including the transparency value and the backlight luminous intensity value is applied to the object to obtain a suitable brightness of the display in block 228.

Figure 8:
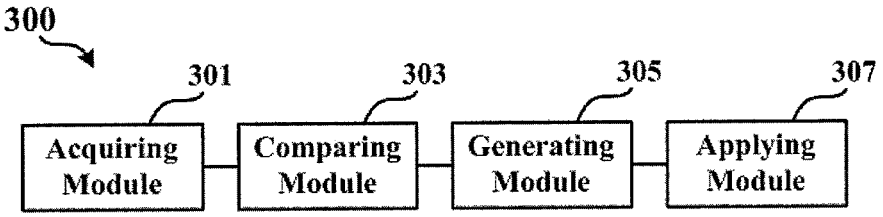
FIG. 8 shows an apparatus 300 for adjusting the brightness of a display according to another embodiment of the present application.

FIG. 8 shows an apparatus 300 for adjusting the brightness of a display according to another embodiment of the present application.

As shown in FIG. 8, the apparatus 300 includes:

an acquiring module 301, configured to acquire a brightness adjusting signal, wherein the brightness adjusting signal includes a position value indicative of a desired brightness of the display;

a comparing module 303, configured to compare the position value with a first threshold, wherein an adjusting scale is defined according to a variable range of transparency of an object displayed on the display if the position value is smaller than the first threshold;

a generating module 305, configured to generate a brightness value of the object according to the position of the position value in the adjusting scale; and an applying module 307, configured to apply the brightness value to the object displayed on the display.

In certain embodiments, the comparing module 303 is further configured to define the adjusting scale according to a variable range of backlight luminous intensity of the display if the position value is equal to or greater than the first threshold. Optionally, the brightness value changes linearly with the position value if the position value is equal to or greater than the first threshold.

In certain embodiments, the brightness value changes nonlinearly with the position value if the position value is smaller than the first threshold. Optionally, the brightness value changes in a logarithmic function of the position value if the position value is smaller than a second threshold, wherein the second threshold is smaller than the first threshold.

In certain embodiments, the apparatus 300 further includes a touch sensing input device configured to generate the brightness adjusting signal in response to a sliding action of a user on the display.

In certain embodiments, the apparatus 300 further includes an application programming interface in a platform coupled to the display. The apparatus 300 is configured to set the backlight luminous intensity of the display via the application programming interface. Optionally, the first threshold corresponds to a minimum brightness that the platform application programming interface coupled to the display can configure.

In certain embodiments, the object is a user interface.

The apparatus 300 described above may be used in various displaying devices such as a mobile communication terminal, a laptop, a pad, a personal digital assistant or other electronic devices with a display.

In another aspect, the present application further provides a display system using the method and apparatus for adjusting the brightness of a display according to the present application. The display system may include an apparatus for adjusting the brightness of the display of the present application (such as the apparatus 300 in FIG. 8). The display system further includes a display and an input module. The input module is configured to generate the brightness adjusting signal in response to an input of a user. The display is configured to display the object in response to the application of the brightness value.

The block diagram shown in FIG. 8 is merely illustrative and not limiting the scope of the present application. In certain embodiments, some modules may be added or reduced according to practical applications. It should be noted that, the present application may be implemented in mobile phones or other electronic device of which schematics are not elaborated in the present application, those skilled in the art will readily appreciate the corresponding implementations of such devices.

The embodiments of the present application may be implemented by hardware, software or any combination thereof. The hardware may be implemented by specific logic circuits, and the software may be stored in a memory and executed by appropriate instruction executing systems. For example, the software may be executed by a micro processor or a specifically designed hardware. Those skilled in the art may understand that the previous apparatus and method of the present application may be implemented by computer-executable instructions and/or control codes contained in the processor. For example, such codes may be provided in storage mediums such as hard disks, CD(s), DVD-ROM(s), programmable memories such as ROM(s), or data mediums such as optical or electrical signal mediums. An apparatus of the present application and its modules may be implemented by hardware circuits including VLSI(s) or gate arrays, semiconductor circuits such as logic circuits or transistors, or programmable hardware devices such as FPGA(s) or PLD(s). An apparatus of the present application may also be implemented by software executable by various processors, or implemented by the combinations of the hardware and software such as firmware.

It should be noted that, although several modules or submodules of the apparatus have been described in the previous paragraphs, such division is not mandatory. The functions and features of two or more modules described above may be embodied in a module. Otherwise, the function and feature of one module described above may be embodied in two or more modules.

Furthermore, although the operation of a method according to the present application is illustrated with reference to the accompanying drawings in a specific sequence, the present application may be practiced using process flows that differ from that illustrated. Additionally, it should be noted that not all steps are required in every embodiment. In other words, one or more of the steps may be omitted or replaced, without departing from the spirit and scope of the invention. In certain embodiments, steps may be performed in different order, in parallel with one another, or omitted entirely, and/or certain additional steps may be performed without departing from the scope of the present application.

While the present application has been illustrated and described in detail in the drawings and foregoing description, such illustration and description are to be considered illustrative or exemplary and not restrictive; the present application is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope. The scope and spirit of the application is defined by the appended claims.

What is claimed is:

1. A method for adjusting the brightness of a display, comprising:

acquiring a brightness adjusting signal, wherein the brightness adjusting signal includes a value indicative of a desired brightness of the display;

comparing the value indicative of the desired brightness of the display with a first threshold, wherein an adjusting scale is defined so that values of the adjusting scale smaller than the first threshold define a variable range of transparency of an object displayed on the display and values of the adjusting scale equal to or greater than the first threshold define a variable range of backlight luminous intensity of the display;

generating a brightness value of the object according to the value of the desired brightness of the display in the adjusting scale; and applying the brightness value to the object displayed on the display by changing the transparency of the object displayed on the display when the value indicative of the desired brightness of the display indicates a variation between values in the adjusting scale that are smaller than the first threshold, and changing the backlight luminous intensity of the display when the value indicative of the desired brightness of the display indicates a variation between values in the adjusting scale that are equal to or greater than the first threshold.

2. The method of claim 1, wherein the brightness value changes linearly with the value indicative of the desired brightness of the display when the value indicative of the desired brightness of the display indicates a variation between values in the adjusting scale that are equal to or greater than the first threshold.

3. The method of claim 1, wherein the brightness value changes nonlinearly with the value indicative of the desired brightness of the display when the value indicative of the desired brightness of the display indicates a variation between values in the adjusting scale that are smaller than the first threshold.

4. The method of claim 1, wherein the brightness value changes in a logarithmic function of the value indicative of the desired brightness of the display when the value indicative of the desired brightness of the display indicates a variation between values in the adjusting scale that are smaller than a second threshold, wherein the second threshold is smaller than the first threshold.

5. The method of claim 1, wherein the brightness adjusting signal is generated in response to a sliding action on the display by a user.

6. The method of claim 1, wherein the first threshold corresponds to a minimum brightness that a platform application programming interface coupled to the display can configure.

7. The method of claim 1, wherein the object is a user interface.

8. An apparatus for adjusting the brightness of a display, comprising:

an acquiring module, configured to acquire a brightness adjusting signal, wherein the brightness adjusting signal includes a value indicative of a desired brightness of the display;

a comparing module, configured to compare the value indicative of the desired brightness of the display with a first threshold, wherein an adjusting scale is defined so that values of the adjusting scale smaller than the first threshold define a variable range of transparency of an object displayed on the display and values of the adjusting scale equal to or greater than the first threshold define a variable range of backlight luminous intensity of the display;

a generating module, configured to generate a brightness value of the object according to the value of the desired brightness of the display in the adjusting scale; and an applying module, configured to apply the brightness value to the object displayed on the display by changing the transparency of the object displayed on the display when the value indicative of the desired brightness of the display indicates a variation between values in the adjusting scale that are smaller than the first threshold, and changing the backlight luminous intensity of the display when the value indicative of the desired brightness of the display indicates a variation between values in the adjusting scale that are equal to or greater than the first threshold.

9. The apparatus of claim 8, wherein the brightness value changes linearly with the value indicative of the desired brightness of the display when the value indicative of the desired brightness of the display indicates a variation between values in the adjusting scale that are equal to or greater than the first threshold.

10. The apparatus of claim 8, wherein the brightness value changes nonlinearly with the value indicative of the desired brightness of the display when the value indicative of the desired brightness of the display indicates a variation between values in the adjusting scale that are smaller than the first threshold.

11. The apparatus of claim 8, wherein the brightness value changes in a logarithmic function of the value indicative of the desired brightness of the display when the value indicative of the desired brightness of the display indicates a variation between values in the adjusting scale that are smaller than a second threshold, wherein the second threshold is smaller than the first threshold.

12. The apparatus of claim 8, further comprising:

a touch sensing input module, configured to generate the brightness adjusting signal in response to a sliding action on the display by a user.

13. The apparatus of claim 8, further comprising an application programming interface in a platform coupled to the display, wherein the apparatus is configured to set the backlight luminous intensity of the display via the application programming interface.

14. The apparatus of claim 13, wherein the first threshold corresponds to a minimum brightness that the platform application programming interface coupled to the display can configure.

15. The apparatus of claim 8, wherein the object is a user interface.

16. A display system, comprising a display, an input module, and the apparatus for adjusting the brightness of the display in claim 8, wherein:

the input module is configured to generate the brightness adjusting signal in response to an input of a user; and the display is configured to display the object in response to the application of the brightness value.

17. The method of claim 1, wherein the brightness value is applied to the object displayed on the display by changing both the transparency of the object displayed on the display and the backlight luminous intensity of the display when the value indicative of the desired brightness of the display indicates a variation between values in the adjusting scale that are respectively smaller than and greater than the first threshold.

18. The apparatus of claim 8, wherein applying module changes both the transparency of the object displayed on the display and the backlight luminous intensity of the display when the value indicative of the desired brightness of the display indicates a variation between values in the adjusting scale that are respectively smaller than and greater than the first threshold.

* * * * *